US010852091B1

(12) United States Patent
Helms et al.

(10) Patent No.: US 10,852,091 B1
(45) Date of Patent: Dec. 1, 2020

(54) SUPPRESSOR FOR A FIREARM

(71) Applicants: Donald Ray Helms, Pisgah Forest, NC (US); Anthony Louis Marfione, Fletcher, NC (US)

(72) Inventors: Donald Ray Helms, Pisgah Forest, NC (US); Anthony Louis Marfione, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/660,928

(22) Filed: Oct. 23, 2019

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/325; F41A 21/34; F41A 21/28
USPC ..... 89/14.4, 14.3
See application file for complete search history.

(56) References Cited

U.S. PATENT DOCUMENTS

| | | | | |
|---|---|---|---|---|
| 3,272,074 | A | 9/1966 | Vinson | |
| 4,576,083 | A | 3/1986 | Seberger, Jr. | |
| 4,588,043 | A | 5/1986 | Finn | |
| 4,813,333 | A | 3/1989 | Garris | |
| 4,920,854 | A | 5/1990 | Scanlon | |
| 5,029,512 | A | 7/1991 | Latka | |
| 5,559,302 | A | 9/1996 | Latka | |
| 5,860,242 | A | 1/1999 | O'Neil | |
| 6,575,074 | B1 | 6/2003 | Gaddini | |
| 7,059,235 | B2 | 6/2006 | Hanslick | |
| 7,832,323 | B1 | 11/2010 | Davies | |
| 7,891,282 | B1 | 2/2011 | DeGroat | |
| 7,931,118 | B1 | 4/2011 | Cronhelm | |
| 8,387,299 | B1 | 3/2013 | Brittingham et al. | |
| 8,584,794 | B2 | 11/2013 | Dueck | |
| 9,470,466 | B2 | 10/2016 | Washburn, III et al. | |
| 9,599,421 | B1 | 3/2017 | Dean | |
| 9,658,019 | B2 | 5/2017 | Smith | |
| 9,746,267 | B2 | 8/2017 | Smith | |
| 9,816,773 | B1 * | 11/2017 | Reis Green | F41A 21/30 |
| 10,119,779 | B1 | 11/2018 | Miele | |
| D837,922 | S * | 1/2019 | McDonald | D22/108 |
| 10,184,745 | B1 * | 1/2019 | Fulton | F41A 21/30 |
| 10,345,070 | B1 | 7/2019 | Lepka | |

(Continued)

FOREIGN PATENT DOCUMENTS

| | | |
|---|---|---|
| DE | 1553874 | 10/1971 |
| DE | 20 2014 004 278 U1 | 9/2014 |
| EP | 2 587 209 A2 | 5/2013 |

*Primary Examiner* — John Cooper
(74) *Attorney, Agent, or Firm* — Steve LeBlanc, LLC

(57) ABSTRACT

A suppressor for a firearm includes a casing and a plurality of baffles inside the casing. A retainer is releasably coupled to the casing downstream from the plurality of baffles, and the retainer has a downstream surface. A rear cap is releasably coupled to the casing upstream from the plurality of baffles, and the rear cap has an upstream surface and a downstream surface. A downstream rear cap surface feature is defined by the downstream surface of the rear cap and has a complementary shape to the downstream surface of the retainer. When the rear cap is removed from the casing, the downstream rear cap surface feature can engage with the downstream surface of the retainer to remove the retainer from the casing.

20 Claims, 12 Drawing Sheets

(56) References Cited

U.S. PATENT DOCUMENTS

| | | | | |
|---|---|---|---|---|
| 10,401,111 | B2 * | 9/2019 | Brittingham | B25B 13/48 |
| 10,605,558 | B1 * | 3/2020 | Marfione | F41A 21/30 |
| 2011/0132683 | A1 | 6/2011 | Miller | |
| 2012/0152649 | A1 | 6/2012 | Larue | |
| 2014/0299405 | A1 | 10/2014 | Miller | |
| 2016/0008968 | A1 | 1/2016 | Neubauer | |
| 2016/0018179 | A1 | 1/2016 | Morris et al. | |
| 2016/0084602 | A1 * | 3/2016 | Smith | F41A 21/325 89/14.4 |
| 2016/0161203 | A1 | 6/2016 | Wilson | |
| 2016/0187093 | A1 | 6/2016 | Barrett | |
| 2017/0067711 | A1 | 3/2017 | Slack | |
| 2017/0131065 | A1 | 5/2017 | Whitson | |
| 2017/0205175 | A1 | 7/2017 | Garst | |
| 2017/0261281 | A1 * | 9/2017 | Salvador | F41A 21/325 |
| 2017/0299312 | A1 | 10/2017 | Llewellyn, Jr. | |
| 2018/0172383 | A1 | 6/2018 | James | |
| 2018/0299223 | A1 | 10/2018 | Barrett | |
| 2018/0321008 | A1 | 11/2018 | Barney | |
| 2018/0347931 | A1 | 12/2018 | Schoppman | |
| 2019/0063859 | A1 | 2/2019 | Gilpin | |
| 2019/0093973 | A1 | 3/2019 | Hamby | |

* cited by examiner

SUPPRESSOR FOR A FIREARM

FIELD OF THE INVENTION

The present invention generally involves a suppressor for a firearm.

BACKGROUND OF THE INVENTION

A conventional firearm operates by combusting gunpowder or other accelerant to generate combustion gases that propel a projectile through a barrel and out of a muzzle of the firearm. The rapidly expanding combustion gases exit the muzzle and produce a characteristic loud bang commonly associated with gunfire.

A suppressor (also commonly referred to as a silencer) is a device that attaches to the muzzle of the firearm to dissipate energy of the combustion gases to reduce the noise signature of the firearm. The suppressor generally includes a number of baffles serially arranged or stacked inside a casing. A longitudinal pathway through the baffle stack allows the projectile to pass through the suppressor unobstructed, while the baffle stack redirects the combustion gases inside the casing to allow the combustion gases to expand, cool, and otherwise dissipate energy before exiting the suppressor. The combustion gases thus exit the suppressor with less energy, reducing the noise signature associated with the discharge of the firearm.

Some suppressor designs include additional components upstream and/or downstream of the baffles to enhance the performance of the suppressor. For example, some suppressor designs include a baffle stack support assembly upstream of the baffles to facilitate connecting the suppressor to the muzzle of the firearm and/or to pre-condition the combustion gases upstream of the baffles. Other suppressor designs may alternately or additionally include an extension interface, an extension module, and/or a front cap assembly downstream of the baffles. The extension interface provides axial support to upstream baffles and the capability to add additional baffles in the extension module, if so desired. The front cap assembly provides additional axial support to the upstream baffles and further conditions the combustion gases before exiting the suppressor to enhance the expansion, cooling, and/or energy dissipation of the combustion gases passing through the suppressor.

While numerous suppressor designs exist to reduce the noise signature of a firearm, the need exists for continued improvements that further reduce the noise signature of a firearm. In particular, improvements in axially supporting the baffle stack and conditioning the combustion gases downstream from the baffle stack before exiting the suppressor may enhance the expansion, cooling, and/or energy dissipation of the combustion gases passing through the suppressor, reducing the noise signature associated with the discharge of the firearm. In addition, the various optional components typically releasably attach to the casing to enable rapid installation, removal, and servicing of the optional components when necessary to optimize the configuration and performance for the suppressor. A separate tool is often needed to securely install or rapidly remove the components from the suppressor. While the use of a separate tool may provide for more secure installation or facilitate faster removal of the components, the need for a separate tool may impact continued operation, modification, or maintenance of the suppressor in the field where the tool may be lost or otherwise not available. Therefore, the need exists for an improved suppressor that reduces the noise signature associated with the discharge of the firearm and/or does not require a separate tool to securely install or rapidly remove components from the suppressor.

BRIEF DESCRIPTION OF THE INVENTION

Aspects and advantages of the invention are set forth below in the following description, or may be obvious from the description, or may be learned through practice of the invention.

One embodiment of the present invention is a suppressor for a firearm. The suppressor includes a casing that defines a rear end opposed to a front end. A plurality of baffles are inside the casing. A retainer is releasably coupled to the casing downstream from the plurality of baffles, and the retainer has a downstream surface. A front cap is releasably coupled to the front end of the casing downstream from the retainer, and the front cap has an upstream surface. An upstream front cap surface feature is defined by the upstream surface of the front cap. A rear cap is releasably coupled to the rear end of the casing upstream from the plurality of baffles, and the rear cap has an upstream surface and a downstream surface. An upstream rear cap surface feature is defined by the upstream surface of the rear cap and has a complementary shape to the upstream front cap surface feature. A downstream rear cap surface feature is defined by the downstream surface of the rear cap and has a complementary shape to the downstream surface of the retainer. When the front cap is removed from the front end of the casing, the upstream front cap surface feature can engage with the upstream rear cap surface feature to remove the rear cap from the rear end of the casing. When the rear cap is removed from the rear end of the casing, the downstream rear cap surface feature can engage with the downstream surface of the retainer to remove the retainer from the casing.

An alternate embodiment of the present invention is a suppressor for a firearm that includes a casing that defines a rear end opposed to a front end. A plurality of baffles are inside the casing. A front cap is releasably coupled to the front end of the casing downstream from the plurality of baffles, and the front cap has an upstream surface. A retainer is releasably coupled to the casing between the plurality of baffles and the front cap, and the retainer has a downstream surface. A rear cap is releasably coupled to the rear end of the casing upstream from the plurality of baffles, and the rear cap has an upstream surface and a downstream surface. A downstream rear cap surface feature is defined by the downstream surface of the rear cap and has a complementary shape to the downstream surface of the retainer. When the front cap is removed from the front end of the casing and the rear cap is removed from the rear end of the casing, the downstream rear cap surface feature can engage with the downstream surface of the retainer to remove the retainer from the casing.

In yet another embodiment of the present invention, a suppressor for a firearm includes a casing and a plurality of baffles inside the casing. A retainer is releasably coupled to the casing downstream from the plurality of baffles, and the retainer has a downstream surface. A rear cap is releasably coupled to the casing upstream from the plurality of baffles, and the rear cap has an upstream surface and a downstream surface. A downstream rear cap surface feature is defined by the downstream surface of the rear cap and has a complementary shape to the downstream surface of the retainer. When the rear cap is removed from the casing, the downstream rear cap surface feature can engage with the downstream surface of the retainer to remove the retainer from the casing.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
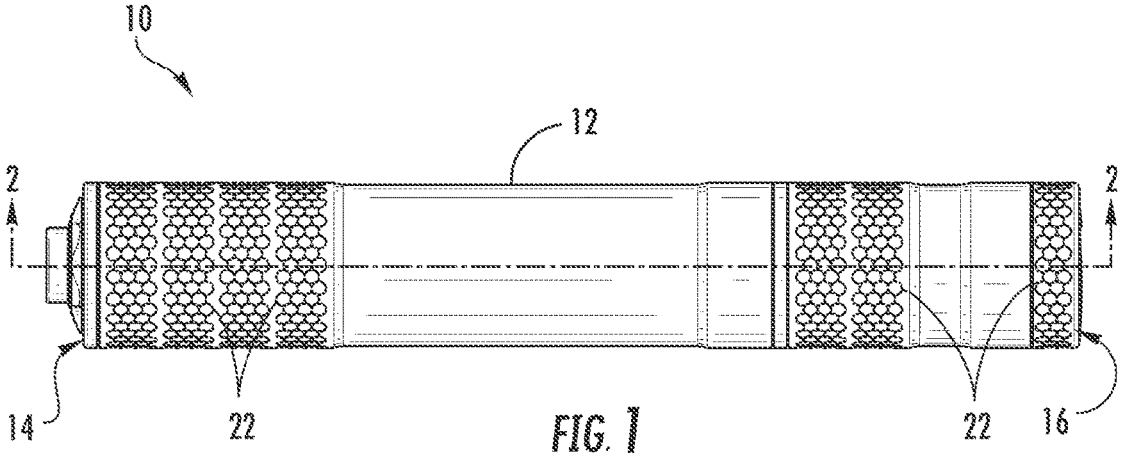
FIG. 1 is a side plan view of a suppressor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A. As used herein, the term "axial" refers to a direction of flow through an object; the term "radial" refers to a direction extending away from the center of an object or normal to the "axial" direction, and the term "circumferential" refers to a direction extending around the circumference or perimeter of an object.

Figure 2:
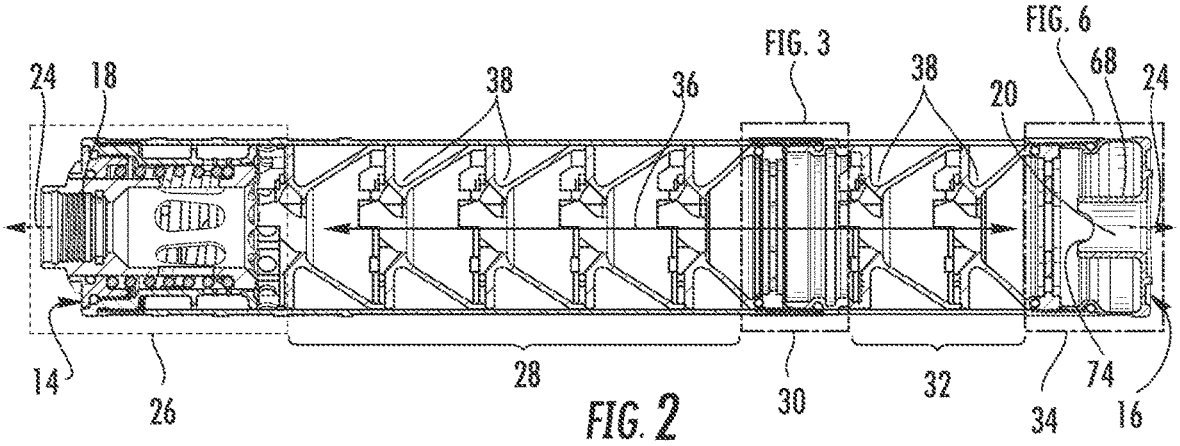
FIG. 2 is a side cross-section view of the suppressor shown in FIG. 1 taken along line 2-2.

Embodiments of the present invention provide a suppressor for a firearm with improved sound damping and/or thermal performance compared to existing suppressor designs. FIG. 1 provides a side plan view of a suppressor 10 according to one embodiment of the present invention, and FIG. 2 provides a side cross-section view of the suppressor 10 shown in FIG. 1 taken along line 2-2. As shown in FIGS. 1 and 2, the suppressor 10 generally includes a casing 12 that contains the internal components of the suppressor 10 and provides the structure for connecting the suppressor 10 to the firearm. For convention, a rear end 14 of the casing 12 refers to the end of the casing 12 that connects to the firearm, and a front end 16 of the casing 12 refers to the opposite end of the casing 12 from which a bullet or other projectile exits. The rear end 14 of the casing 12 generally includes threads 18 or other structure known in the art for attaching the suppressor 10 to the muzzle end of the firearm. The front end 16 of the casing 12 generally terminates in an opening 20 through which the bullet or other projectile from the firearm passes. The casing 12 may further include various textured surfaces 22 between the rear and front ends 14, 16 to facilitate handling and gripping the suppressor 10.

As shown in FIG. 2, the casing 12 generally defines a longitudinal axis 24 for the suppressor 10 and contains the internal components of the suppressor 10. The casing 12 and internal components of the suppressor 10 may be constructed from any material suitable for exposure to the pressures and temperatures normally associated with the discharge of a firearm. For example, in particular embodiments, the casing 12 and internal components of the suppressor 10 may be constructed from metal, fiberglass, carbon, polymers, or other composite materials known in the art. The casing 12 is typically cylindrical, although the particular geometry of the casing 12 is not a limitation of the present invention unless specifically recited in the claims.

In the particular embodiment shown in FIG. 2, the suppressor 10 generally includes a rear baffle stack support assembly 26, a baffle stack assembly 28, an extension interface 30, an extension module 32, and a front cap assembly 34 that define a fluid pathway 36 along the longitudinal axis 24 through the suppressor 10. The rear baffle stack support assembly 26 generally includes structure for connecting the suppressor 10 to the firearm, as well as structure for pre-conditioning the combustion gases upstream of the baffle stack assembly 28. The baffle stack assembly 28 generally includes a series of baffles 38 in a stacked relationship to further cool and reduce the energy of the combustion gases. For example, as shown in FIG. 2, the baffle stack assembly 28 may include five baffles 38 sequentially stacked together. The extension interface 30 provides axial support to upstream baffles 38 and expansion capability to add additional baffles 38 in the extension module 32, if so desired. The front cap assembly 34 provides additional axial support to the upstream baffles 38 and further conditions the combustion gases before exiting the suppressor 10 to enhance the expansion, cooling, and/or energy dissipation of the combustion gases passing through the suppressor 10.

Figure 3:
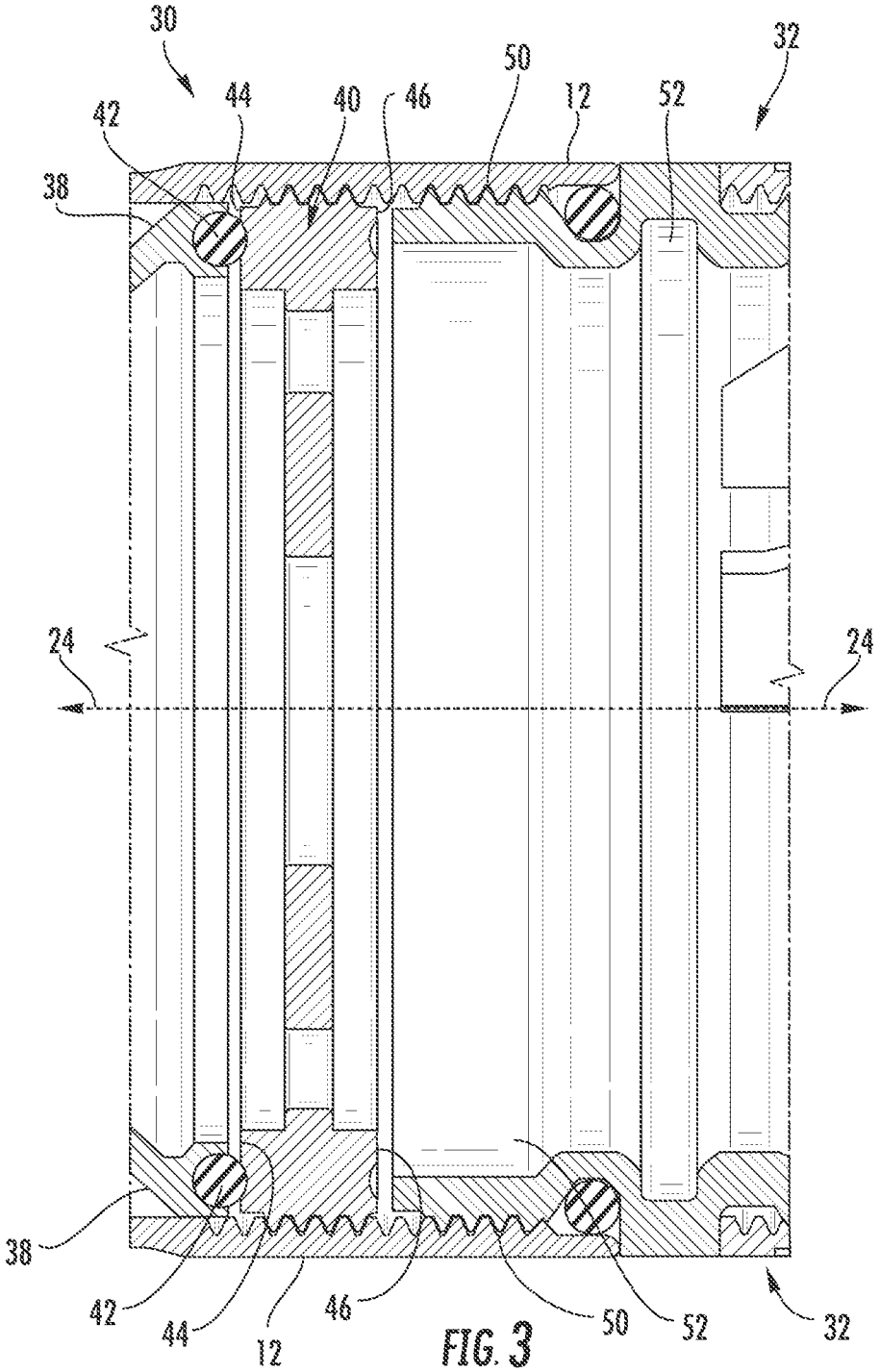
FIG. 3 is an enlarged side cross-section view of the extension interface shown in FIG. 2.

FIG. 3 provides an enlarged cross-section view of the extension interface 30 shown in FIG. 2. As shown in FIG. 3, the extension interface 30 includes a retainer 40 and an annular compression ring 42 between the retainer 40 and the upstream baffles 38. The retainer 40 has an upstream surface 44 axially opposed to a downstream surface 46 and is releasably coupled to the casing 12. For example, as shown in FIG. 3, the retainer 40 may be in threaded engagement with the casing 12 to facilitate assembly and disassembly of the internal components of the suppressor 10. Once coupled to the casing 12, the retainer 40 provides axial support to hold the upstream baffles 38 in place. The annular compression ring 42 extends circumferentially between the immediately upstream baffle 38 and the retainer 40 to provide a fluid seal between the retainer 40 and the immediately upstream baffle 38. In addition, thermal expansion and contraction may cause the upstream baffles 38 to shift axially, and the annular compression ring 42 expands and compresses axially as needed to absorb this axial movement.

Downstream from the retainer 40, the extension interface 30 is configured to receive either an extension module 32, if more baffles 38 are desired, or a front cap 48, terminating the suppressor 10. In the particular embodiment shown in FIGS. 1-3, for example, additional threads 50 in the casing 12 downstream from the retainer 40 may provide threaded coupling for an adapter 52 for the extension module 32. As shown in FIG. 2, the extension module 32 includes two additional baffles 38 downstream from the retainer 40 between the extension interface 30 and the front cap assembly 34. If additional baffles 38 are not desired, then the threads 50 downstream from the retainer 40 may provide threaded coupling for the front cap 48, as will be described with respect to FIG. 6.

Figure 4:
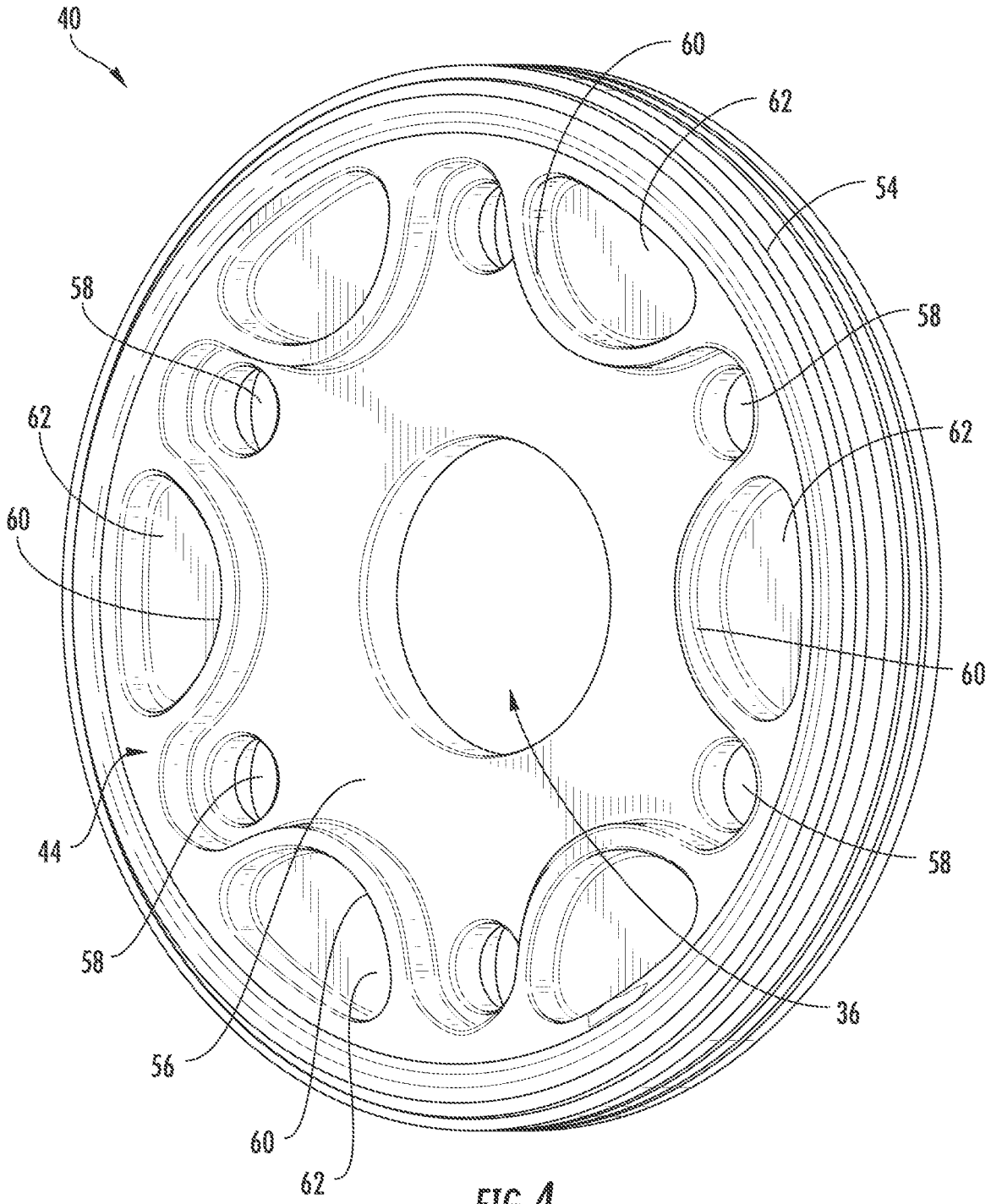
FIG. 4 is an upstream perspective view of a retainer according to one embodiment of the present invention.
Figure 5:
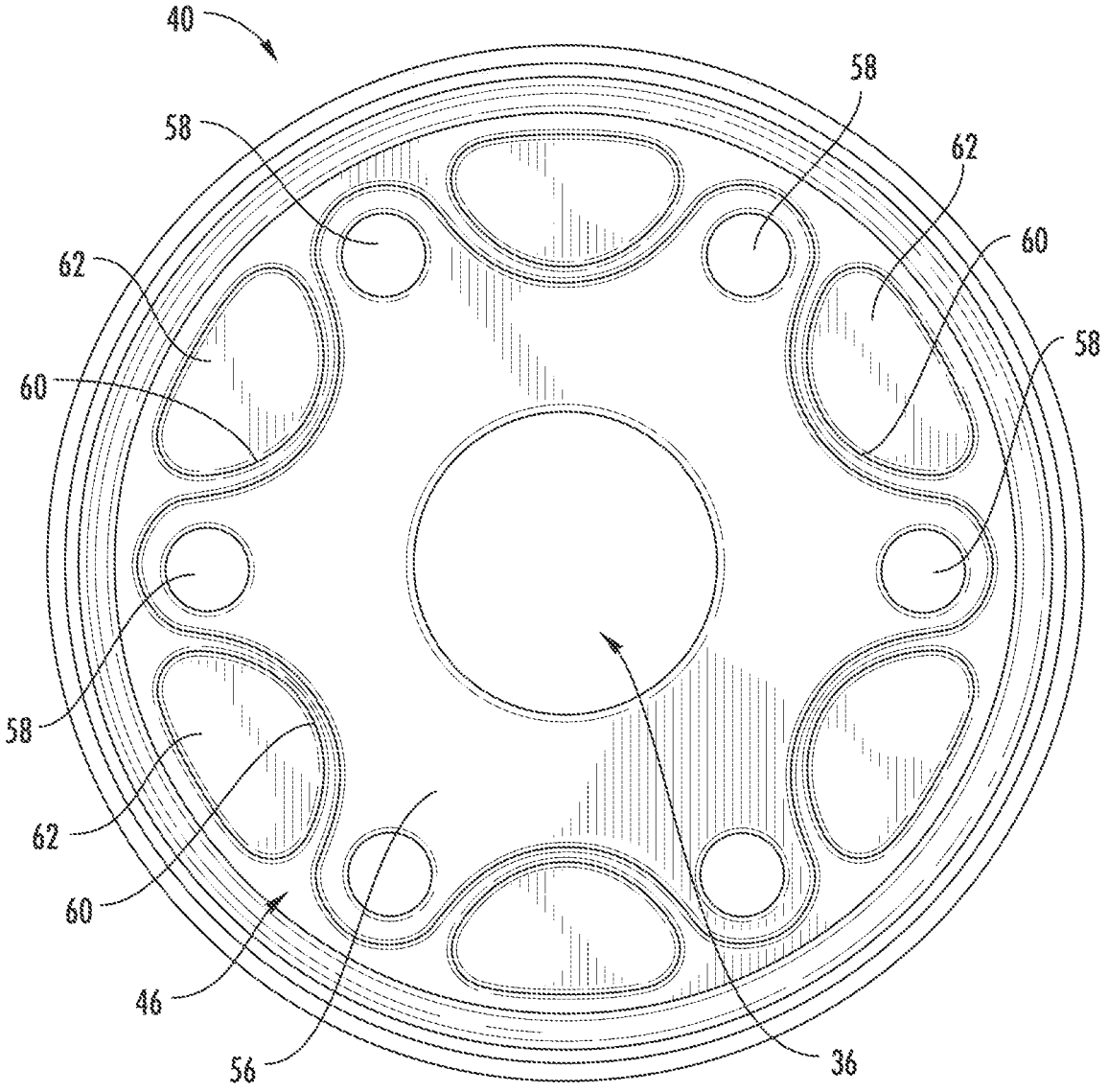
FIG. 5 is a downstream plan view of the retainer shown in FIG. 4.

FIG. 4 provides an upstream perspective view of the retainer 40 according to one embodiment of the present invention, and FIG. 5 provides a downstream plan view of the retainer 40 shown in FIG. 4. As shown in FIGS. 4, and 5, the upstream and downstream surfaces 44, 46 are substantially identical or symmetrical, simplifying assembly by allowing the retainer 40 to be installed in the casing 12 in either direction. The retainer 40 may be cylindrical in shape to conform to the internal volume of the casing 12. Threads 54 around the outer circumference of the retainer 40 may provide threaded engagement between the retainer 40 and the casing 12.

The retainer 40 includes several structural features that enhance the expansion, cooling, and/or energy dissipation of the combustion gases passing through the suppressor 10. For example, a substantially flat surface 56 on the upstream and downstream surfaces 44, 46 defines the fluid pathway 36 along the longitudinal axis 24 of the casing 12. It is believed that the substantially flat surface 56 adjacent to the fluid pathway 36 reduces the amount of turbulent flow in the immediate vicinity of the fluid pathway 36 to reduce any heating of the combustion gases flowing through the fluid pathway 36.

A plurality of apertures 58 radially disposed from the fluid pathway 36 pass through the upstream and downstream surfaces 44, 46 of the retainer 40. The apertures 58 provide an additional flow path for combustion gases through the retainer 40 that is not through the fluid pathway 36.

A contoured wall 60 extends axially upstream from the upstream surface 44 and downstream from the downstream surface 46 to form or define a plurality of damping wells 62 in the upstream and downstream surfaces 44, 46. As shown in FIGS. 4 and 5, the damping wells 62 may be radially disposed from the fluid pathway 36 and circumferentially separated by the apertures 58. The contoured wall 60 and resulting damping wells 62 provide several advantages over existing designs to enhance the performance of the suppressor 10. For example, the additional surface area provided by the contoured wall 60 increases cooling to the combustion gases flowing through the suppressor 10. The increased cooling in turn reduces the pressure and velocity of the combustion gases, providing a corresponding reduction in the energy of the combustion gases exiting the suppressor 10. In addition, the perimeters formed by the contoured wall 60 create separate damping wells 62 that further disrupt the flow of combustion gases through the suppressor 10, thereby further reducing the velocity of the combustion gases.

As previously described and shown in FIG. 2, the extension module 32 connects between the extension interface 30 and the front cap assembly 34 to provide additional baffles 38 inside the casing 12. As with the extension interface 30, the downstream end of the extension module 32 is configured to receive either another extension module 32, if more baffles 38 are desired, or the front cap assembly 34, terminating the suppressor 10.

Figure 6:
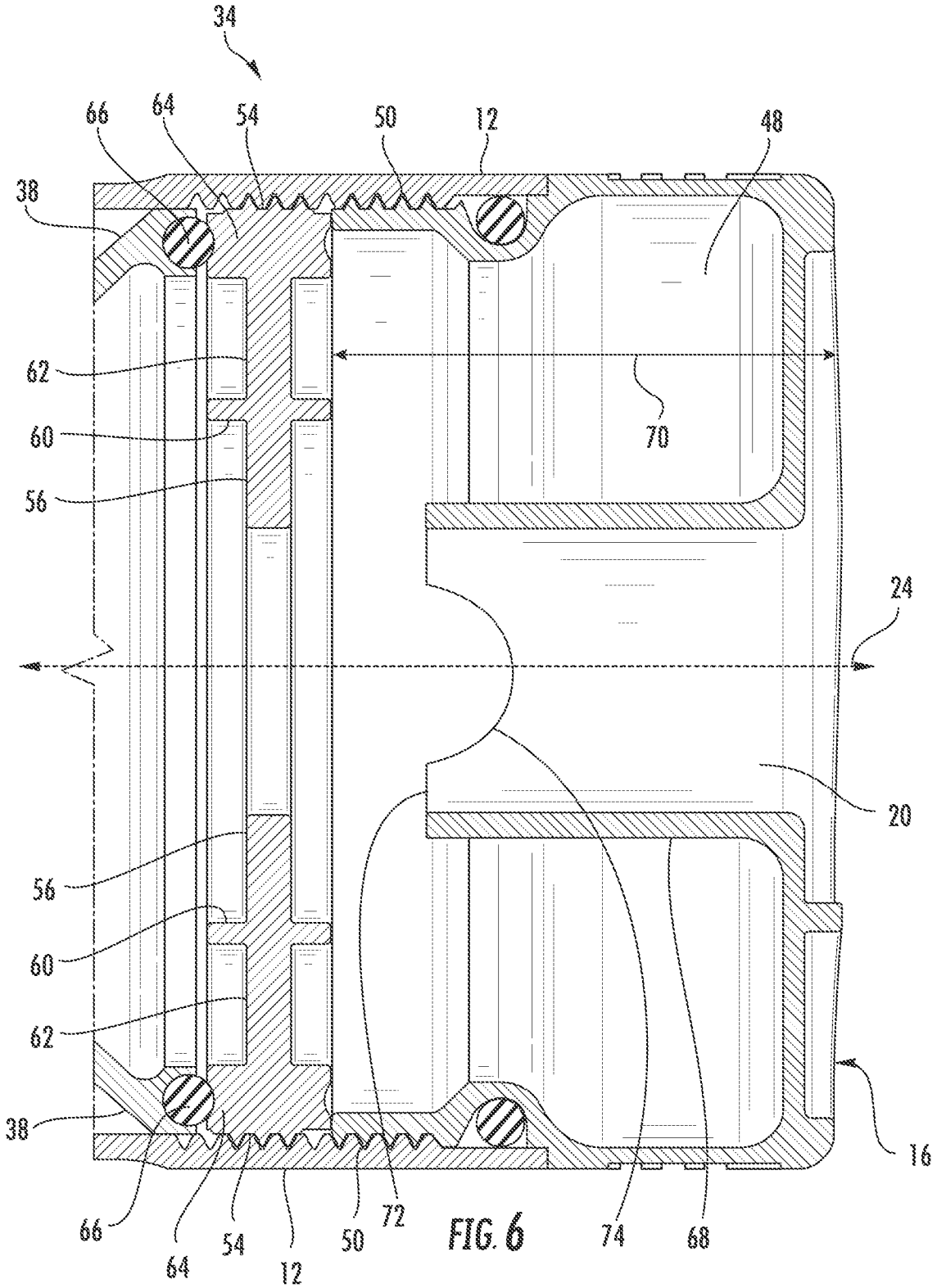
FIG. 6 is an enlarged side cross-section view of the front cap assembly shown in FIG. 2.

FIG. 6 provides an enlarged side cross-section view of the front cap assembly 34 shown in FIG. 2. As shown in FIG. 6, the interface between the extension module 32 and the front cap assembly 34 includes a second retainer 64 and second annular compression ring 66 as previously described and illustrated with respect to FIGS. 3-5. Specifically, the second retainer 64 is symmetrical and includes the threads 54, flat surface 56, apertures 58, contoured wall 60, and damping wells 62 as shown in FIGS. 4 and 5. In addition, the second annular compression ring 66 is disposed between the second retainer 64 and the upstream baffles 38 to provide a fluid seal between the second retainer 64 and the immediately upstream baffle 38 and to expand and compress axially to absorb axial movement of the upstream baffles 38.

As shown in FIG. 6, the front cap 48 is in threaded engagement with the casing 12 at the front end 16 of the suppressor 10. The opening 20 in the front cap 48 defines the fluid pathway 36 along the longitudinal axis 24 to allow the projectile and combustion gases to exit the suppressor 10. As shown in FIGS. 2 and 6, the opening 20 may be defined by a cylindrical tube 68 that extends upstream from the front end 16 of the suppressor 10. In particular embodiments, the cylindrical tube 68 may extend upstream from the front end 16 of the suppressor 10 more than 25% or 50% of an axial length 70 of the front cap 48. In addition, as shown most clearly in FIG. 6, the cylindrical tube 68 may include an upstream end 72 with an arcuate relief 74 at the upstream end 72. It is believed that the cylindrical tube 68 in conjunction with the arcuate relief 74 further dampens noise from the suppressor 10 by enhancing the expansion, cooling, and/or energy dissipation of the combustion gases prior to exiting the front cap 48 of the suppressor 10.

Figure 7:
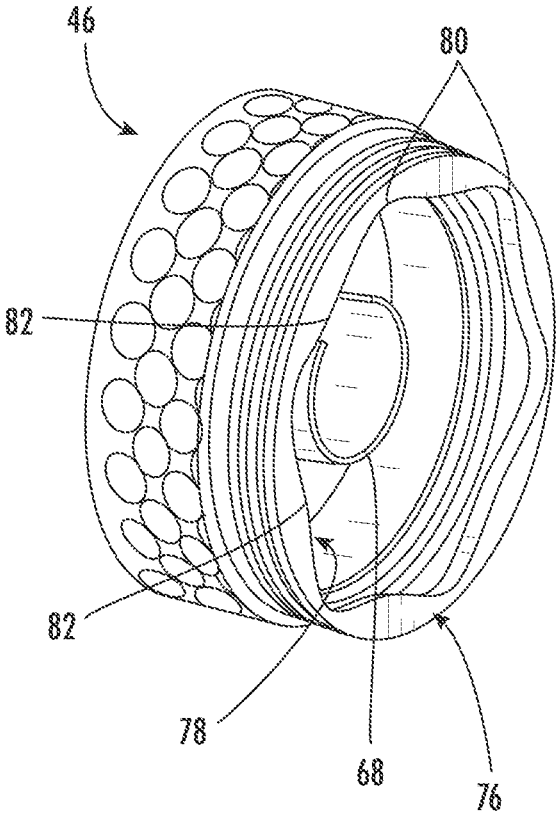
FIG. 7 is an upstream perspective view of the front cap shown in FIGS. 2 and 6 removed from the suppressor.
Figure 8:
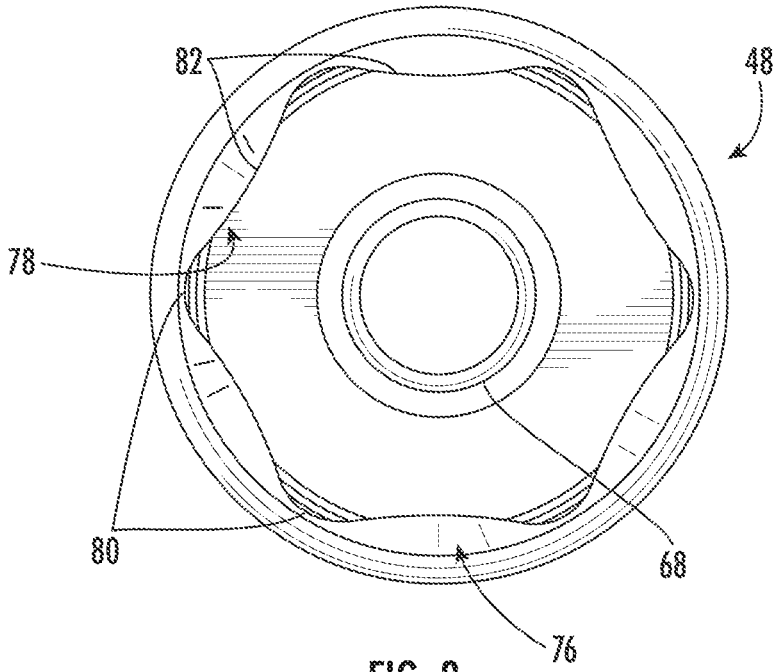
FIG. 8 is an upstream plan view of the front cap shown in FIGS. 2 and 6 removed from the suppressor.

FIG. 7 provides an upstream perspective view and FIG. 8 provides an upstream plan view of the front cap 48 shown in FIGS. 2 and 6 removed from the suppressor 10. As shown in FIGS. 7 and 8, the front cap 48 includes an upstream surface 76 that defines an upstream front cap surface feature 78. In the particular embodiment shown in FIGS. 7 and 8, the upstream front cap surface feature 78 is a hexagonal shape that extends radially inward in the upstream surface 76, with six vertices 80 separated by six sides 82. Although the vertices 80 are rounded and the sides 82 are curved, embodiments of the present invention are not limited to any particular geometry unless specifically recited in the claims.

Testing of the suppressor 10 with this particular surface feature 78 in the upstream surface 76 of the front cap 48 indicated a measurable noise signature reduction associated with the discharge of the firearm, as summarized below in Table 1.

TABLE 1

Conditions: 82° F., 27.54 mm pressure, Glock ® 19X, Fiocchi ® 147 grain

| Configuration | Average dB Level | Average dB Reduction |
|---|---|---|
| Baseline - no suppressor | 159.87 dB | N/A |
| Test 1: 5 baffle suppressor; no surface feature | 130.56 dB | 29.31 dB |
| Test 2: 5 baffle suppressor; surface feature | 129.16 dB | 30.71 dB |
| Test 3: 7 baffle suppressor; no surface feature | 126.09 dB | 33.78 dB |
| Test 4: 7 baffle suppressor; surface feature | 125.49 dB | 34.38 dB |

The testing summarized above in Table 1 was conducted with ambient conditions of 82 degrees Fahrenheit and a barometric pressure of 27.54 mm using a Glock® 19X with Fiocchi® 147 grain, 9 mm ammunition. Ten shots were taken for each configuration, and the dB level for each shot was recorded, with the average dB level for each configuration shown in Table 1. The baseline configuration was conducted without any suppressor attached to the firearm and produced an average dB level of 159.87 dB.

The Test 1 configuration included the suppressor 10 shown in FIGS. 1 and 2 without the extension module 32 and with the front cap 48 shown in FIGS. 7 and 8 without the upstream front cap surface feature 78. The Test 1 configuration produced an average dB level of 130.56 dB. The Test 2 configuration included the same suppressor 10 used in Test 1, except the front cap 48 included the upstream front cap surface feature 78 shown in FIGS. 7 and 8. The Test 2 configuration produced an average dB level of 129.16 dB. The results from Tests 1 and 2 thus indicate that the upstream front cap surface feature 78 shown in FIGS. 7 and 8 produced an additional 1.4 dB reduction in the noise signature of the firearm 10.

The Test 3 configuration included the suppressor 10 shown in FIGS. 1 and 2 with the extension module 32 and with the front cap 48 shown in FIGS. 7 and 8 without the upstream front cap surface feature 78. The Test 3 configuration produced an average dB level of 129.06 dB. The Test 4 configuration included the same suppressor 10 used in Test 3, except the front cap 48 included the surface feature 78 shown in FIGS. 7 and 8. The Test 4 configuration produced an average dB level of 125.49 dB. The results from Tests 3 and 4 thus indicate that the surface feature 78 shown in FIGS. 7 and 8 produced an additional 0.6 dB reduction in the noise signature of the firearm 10.

Although the testing described above demonstrates a measurable noise signature reduction for the surface feature 78 having a hexagonal shape, it is anticipated that other geometric shapes of the surface feature 78 having rounded vertices 80 separated by curved sides 82 will have comparable noise signature reductions, and particular embodiments of the present invention are not limited to any geometric shape or number of rounded vertices 80 or curved sides 82 unless specifically recited in the claims.

Figure 9:
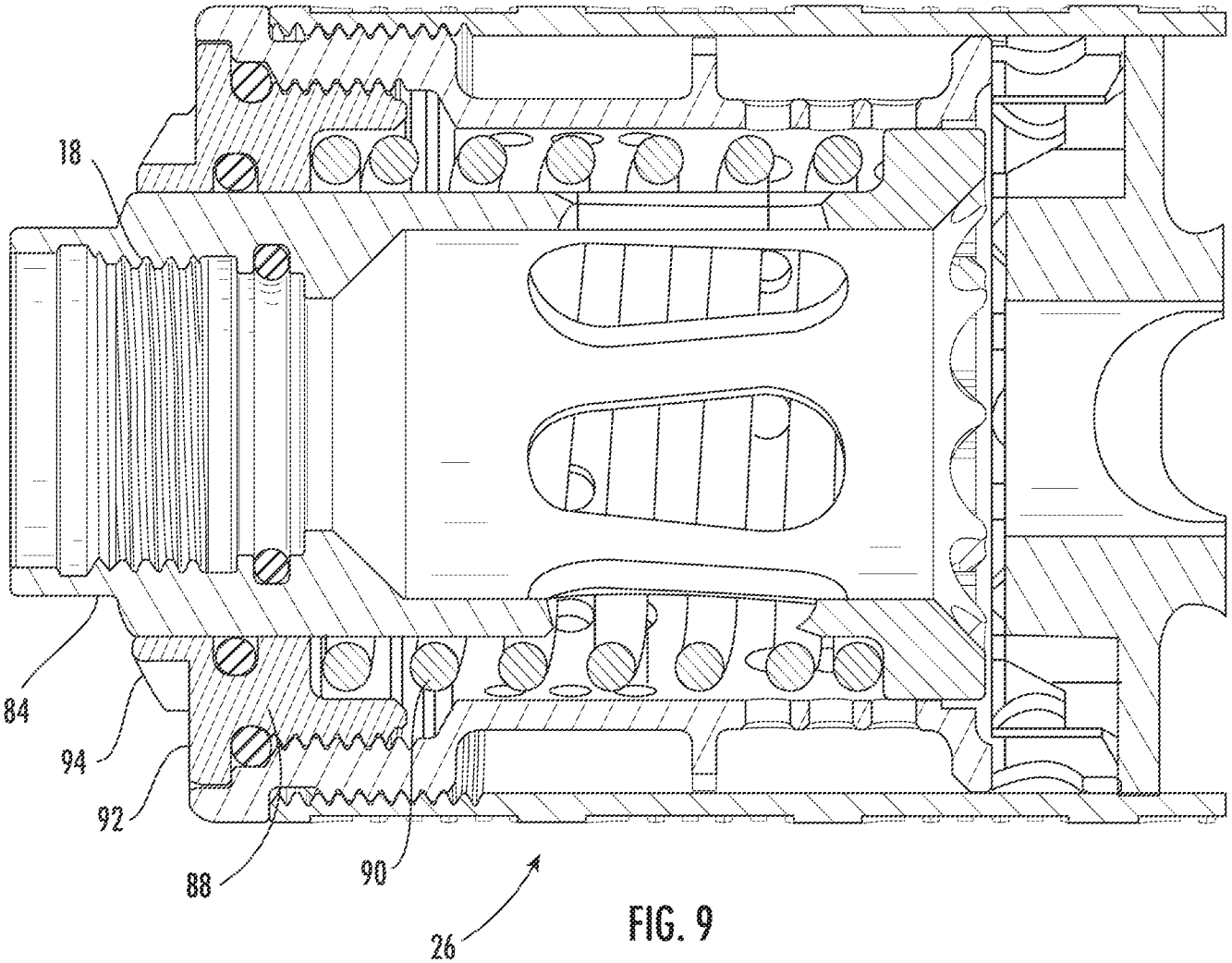
FIG. 9 is an enlarged side cross-section view of the rear baffle stack support assembly shown in FIG. 2.

FIG. 9 provides an enlarged side cross-section view of the rear baffle stack support assembly 26 shown in FIG. 2. In this particular embodiment, the rear baffle stack support assembly 26 includes an adaptor 84 with female threads 18 located at the rear end 14 of the casing 12. As shown in FIG. 9, a rear cap 88 is releasably coupled in threaded engagement to the rear end 14 of the casing 12, and a spring 90 is operably engaged between the adaptor 84 and the rear cap 88. The spring 90 biases the adaptor 84 away from the rear cap 88 and into the casing 12, while allowing the adaptor 84 to slide axially with respect to the rear cap 88 to facilitate threading the adaptor 84 onto complementary male threads on the firearm. In addition, the releasable coupling between the rear cap 88 and the casing 12 allows the rear cap 88 to be removed from the casing 12 to facilitate maintenance, repairs, or replacement of components inside the casing 12.

Figure 10:
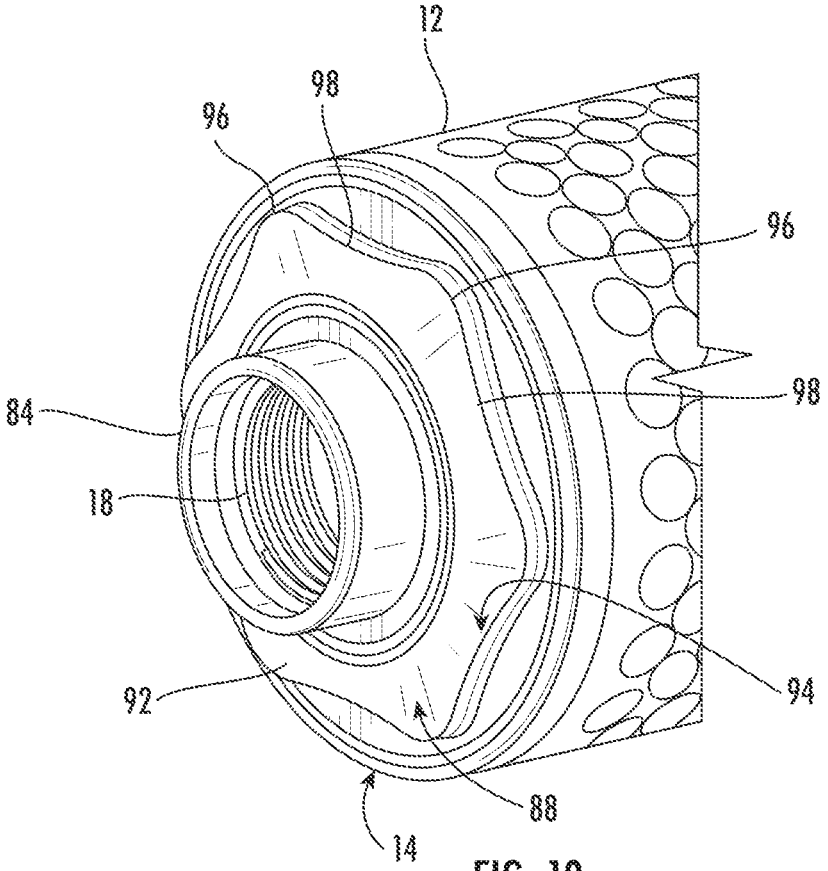
FIG. 10 is a rear perspective view of the suppressor shown in FIGS. 1 and 2.
Figure 11:
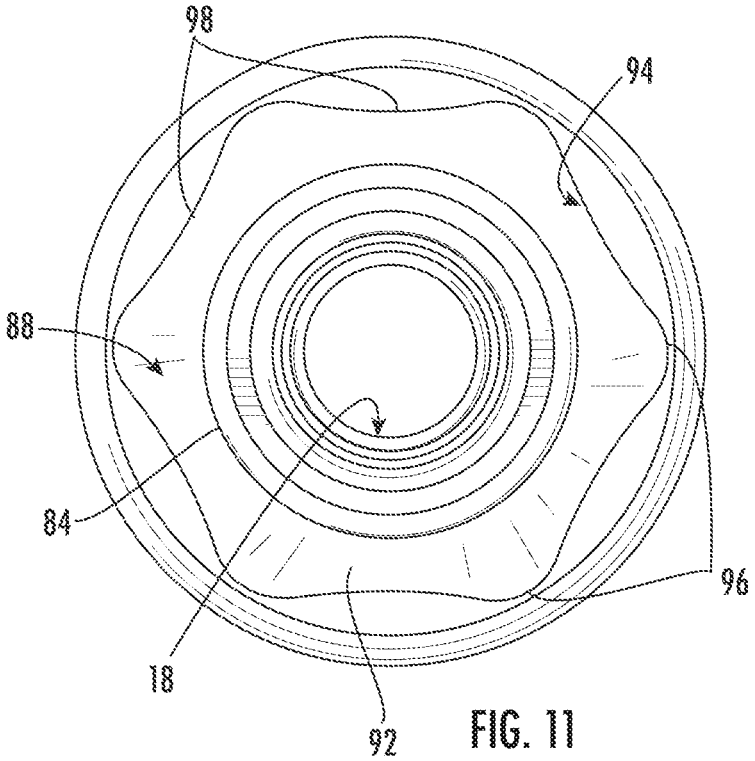
FIG. 11 is an rear plan view of the suppressor shown in FIGS. 1 and 2.

FIG. 10 provides an upstream perspective view and FIG. 11 provides an upstream plan view of the suppressor 10 shown in FIGS. 1 and 2. As shown in FIGS. 10 and 11, the rear cap 88 includes an upstream surface 92 that defines an upstream rear cap surface feature 94. The upstream rear cap surface feature 94 may be any geometric shape, combination of geometric shapes, projection, indention, or combination of projections and/or indentions that allow the rear cap 88 to be gripped or grasped so it may be rotated with respect to the casing 12 to install or remove the rear cap 88 from the casing 12. In the particular embodiment shown in FIGS. 10 and 11, the upstream rear cap surface feature 94 is a hexagonal projection in the upstream surface 92 of the rear cap 88, with six vertices 96 separated by six sides 98. Although the vertices 96 are rounded and the sides 98 are curved, embodiments of the present invention are not limited to any particular geometry unless specifically recited in the claims.

Figure 12:
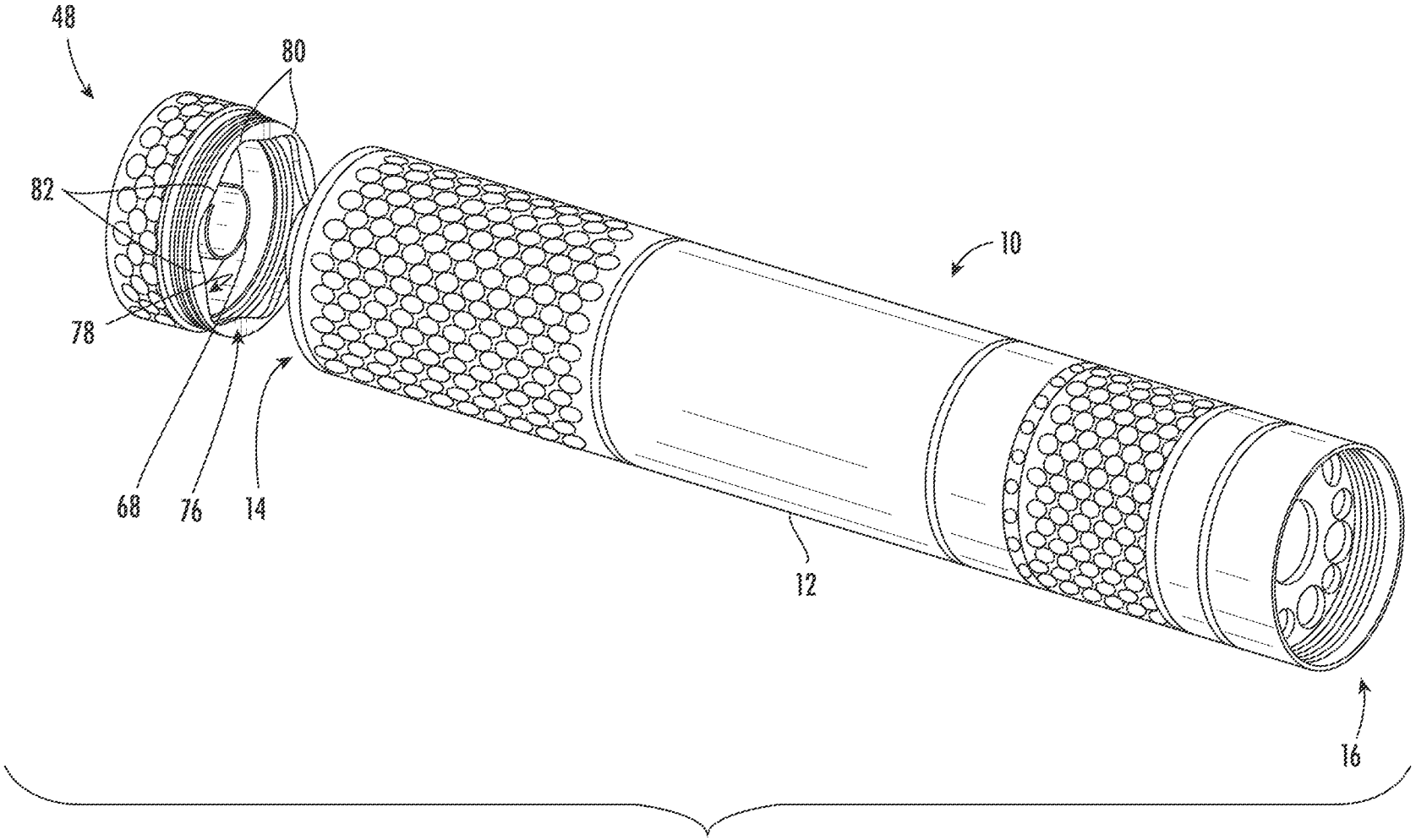
FIG. 12 is a front perspective view of the suppressor shown in FIGS. 1 and 2 with the front cap removed from the front of the suppressor, reversed, and positioned near the rear of the suppressor.

In addition to reducing the noise signature associated with the discharge of the firearm, the upstream front cap surface feature 78 shown in FIGS. 7 and 8 may also be used as a tool to install or remove the rear cap 88. FIG. 12 provides a front perspective view of the suppressor 10 shown in FIGS. 1 and 2 with the front cap 48 removed from the front end 16 of the suppressor 10, reversed, and positioned near the rear end 14 of the suppressor 10. As shown in FIG. 12, the upstream front cap surface feature 78 has a complementary shape to the upstream rear cap surface feature 94 that enables the upstream front cap surface feature 78 to engage with the upstream rear cap surface feature 94. As used herein, the phrase "complementary shape" means that the two opposing surfaces may engage so that one surface may drive or rotate the other surface. As a result, rotation of the front cap 48 will in turn rotate the rear cap 88, allowing the front cap 48 to securely install or rapidly remove the rear cap 88. One of ordinary skill in the art will readily appreciate that various geometries may be selected to provide a complementary shape between the upstream front cap surface feature 78 and the upstream rear cap surface feature 94. For example, one of the upstream rear cap surface feature 94 or the upstream front cap surface feature 78 may be a male fitting and the other may be a female fitting, and the particular geometry for either is not limited unless specifically recited in the claims.

Figure 13:
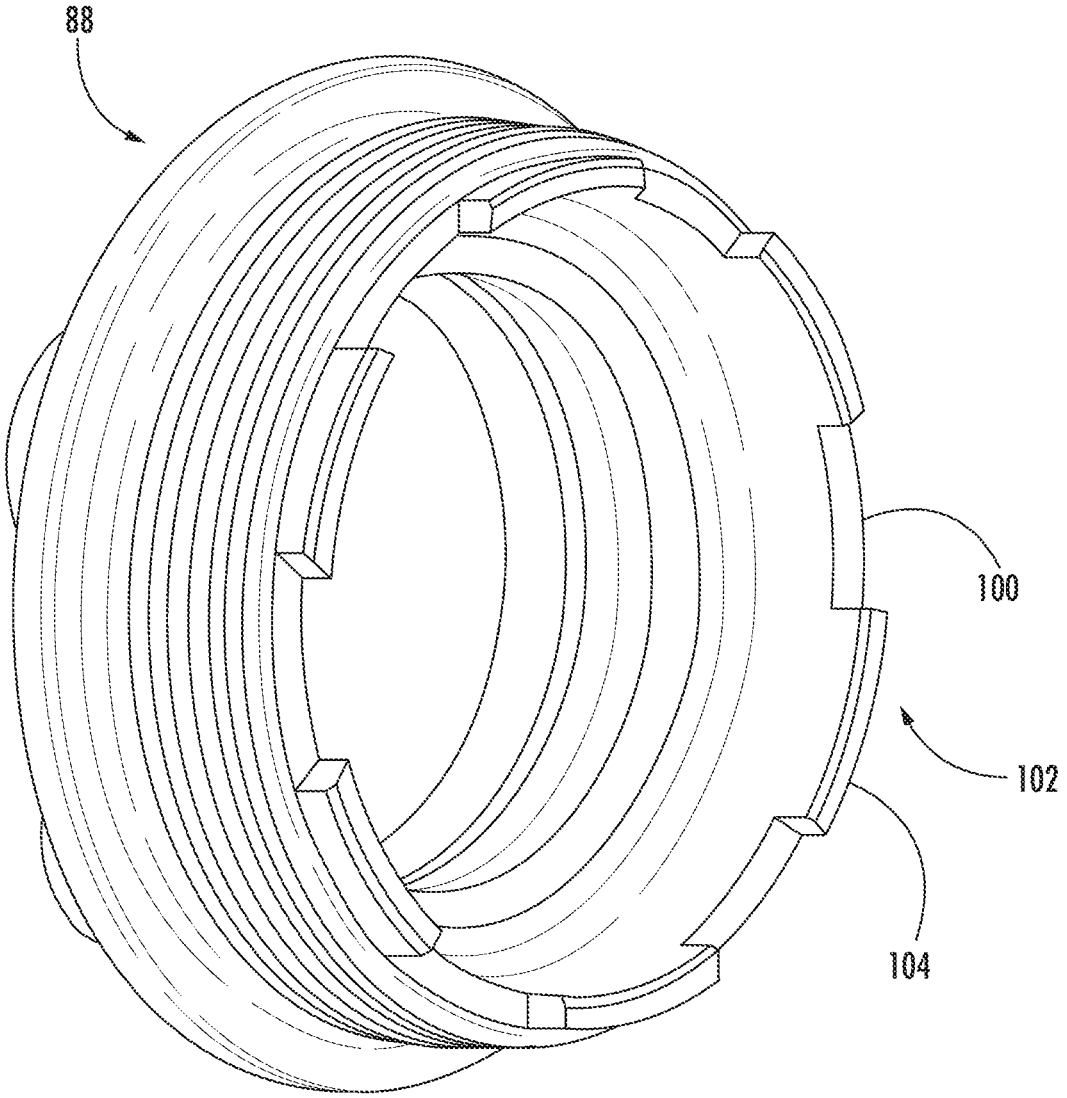
FIG. 13 is a downstream perspective view of the rear cap shown in FIG. 9.

The rear cap 88 may also be used as a tool to install or remove the retainers 40, 64 previously described with respect to FIGS. 4-6 to add or remove the extension module 32 or otherwise service components inside the casing 12. FIG. 13 provides a downstream perspective view of the rear cap 88 shown in FIG. 9. As shown in FIG. 13, the rear cap 88 may include a downstream surface 100 that defines a downstream rear cap surface feature 102. The downstream rear cap surface feature 102 may be any geometric shape, combination of geometric shapes, projection, indention, or combination of projections and/or indentions that provide a complementary shape to the downstream surface 46 of the retainer 40, 64. In the particular embodiment shown in FIG. 13, the downstream rear cap surface feature 102 includes a series of projections 104 that extend axially downstream from the downstream surface 100 of the rear cap 88. The number, spacing, and length of the projections 104 may be selected to provide a complementary shape to the apertures 58, contoured wall 60, and/or damping wells 62 in the downstream surface 46 of the retainer 40, 64. In this manner, when the rear cap 88 is removed from the rear end 14 of the casing 12, the projections 104 of the downstream rear cap surface feature 104 may engage with the apertures 58, contoured wall 60, and/or damping wells 62 in the downstream surface 46 of the retainer 40, 64 to rotate the retainer 40, 64 with respect to the casing 12 to install or remove the retainer 40, 64 from the casing 12.

Figure 14:
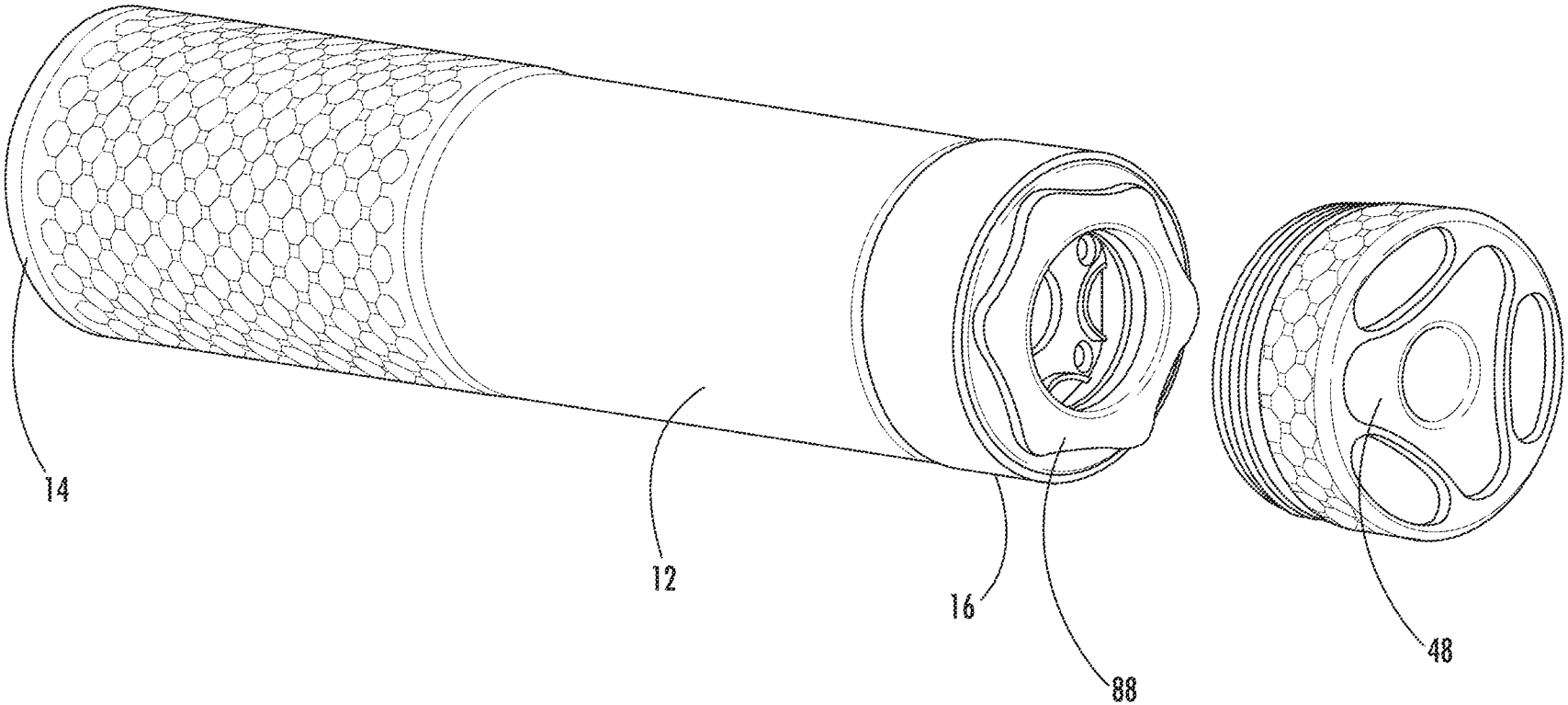
FIG. 14 is a front perspective view of the suppressor shown in FIGS. 1 and 2 with the front cap removed from the front of the suppressor; the rear cap removed from the rear of the suppressor, reversed, and positioned to engage the retainer inside the suppressor; and the front cap in position to engage with the rear cap to remove the retainer.
Figure 15:
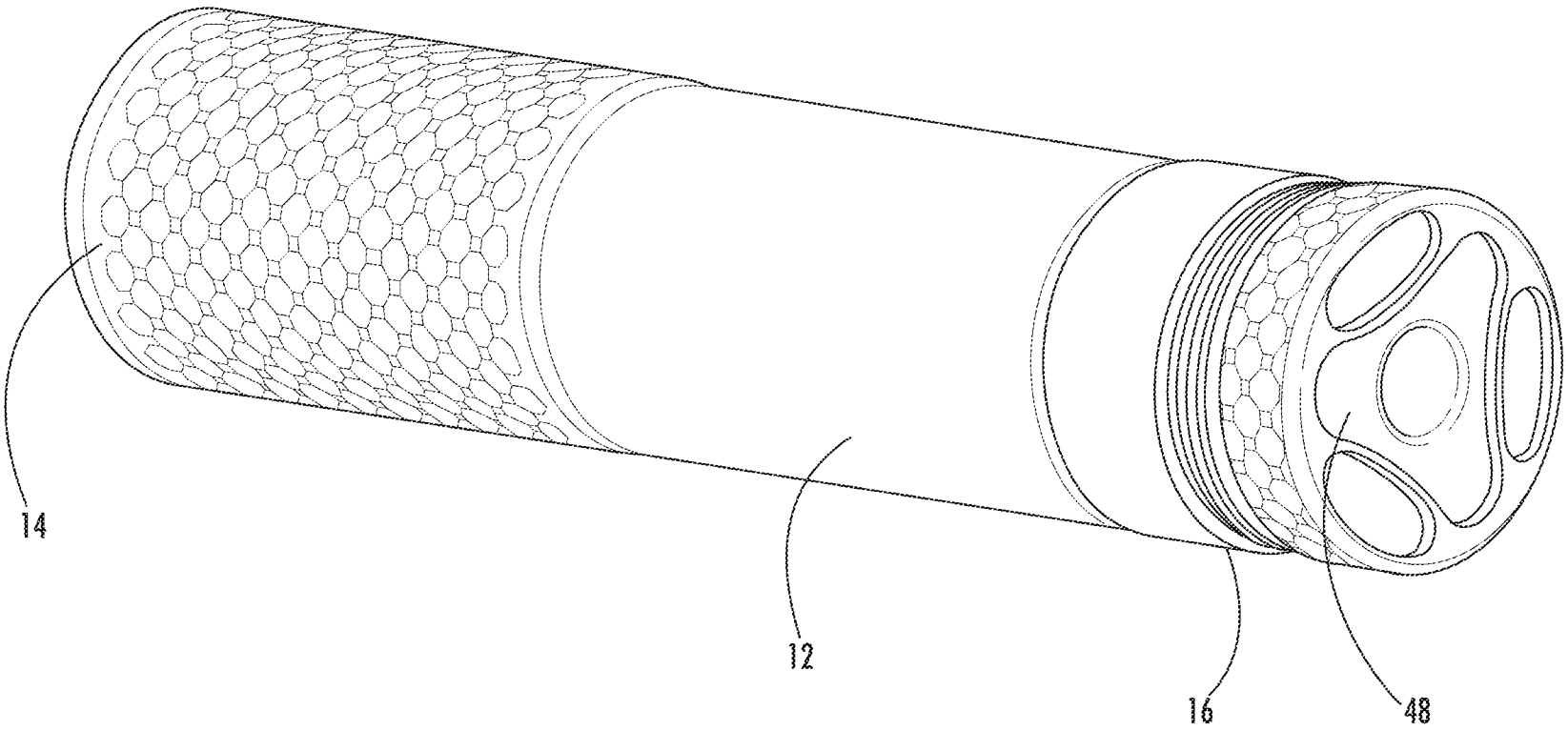
FIG. 15 is a front perspective view of the suppressor shown in FIG. 14 with the front cap engaged with the rear cap to remove the retainer.

FIGS. 14 and 15 provide front perspective views of the suppressor 10 shown in FIGS. 1 and 2 to illustrate the use of the front cap 48 and rear cap 88 as tools to remove the retainer 40, 64. As shown in FIG. 14, the front cap 48 has been removed from the front end 16 of the casing 12. The rear cap 88 has been removed from the rear end 14 of the casing 12 and fits inside the front end 16 of the casing 12 so that the downstream rear cap surface feature 102 engages with the downstream surface 46 of the retainer 40, 64. As shown in FIG. 15, the front cap 48 may then be positioned with the upstream front cap surface feature 78 engaged with the upstream rear cap surface feature 94. In this arrangement, rotation of the front cap 48 in turn rotates the rear 88 which in turn rotates the retainer 40, 64 with respect to the casing 12 to allow the installation and/or removal of the retainer 40, 64.

The various embodiments described and illustrated with respect to FIGS. 1-15 thus provide an improved suppressor 10 having separate tools incorporated into the front cap 48 and/or rear cap 88. A user may thus use either tool to install or remove the rear cap 88 and/or retainer 40, 64 to clean, repair, or replace components inside the casing 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A suppressor for a firearm, comprising:

a casing that defines a rear end opposed to a front end;

a plurality of baffles inside said casing;

a retainer releasably coupled to said casing downstream from said plurality of baffles, wherein said retainer has a downstream surface;

a front cap releasably coupled to said front end of said casing downstream from said retainer, wherein said front cap has an upstream surface;

an upstream front cap surface feature defined by said upstream surface of said front cap;

a rear cap releasably coupled to said rear end of said casing upstream from said plurality of baffles, wherein said rear cap has an upstream surface and a downstream surface;

an upstream rear cap surface feature defined by said upstream surface of said rear cap that has a complementary shape to said upstream front cap surface feature;

a downstream rear cap surface feature defined by said downstream surface of said rear cap that has a complementary shape to said downstream surface of said retainer;

wherein when said front cap is removed from said front end of said casing, said upstream front cap surface feature can engage with said upstream rear cap surface feature to remove said rear cap from said rear end of said casing; and wherein when said rear cap is removed from said rear end of said casing, said downstream rear cap surface feature can engage with said downstream surface of said retainer to remove said retainer from said casing.

2. The suppressor as in claim 1, wherein said retainer is in threaded engagement with said casing.

3. The suppressor as in claim 1, wherein said downstream surface of said retainer comprises a plurality of walls that extend axially downstream from said downstream surface of said retainer.

4. The suppressor as in claim 1, wherein said upstream front cap surface feature extends radially inward from said upstream surface of said front cap and comprises a plurality of vertices separated by a plurality of sides.

5. The suppressor as in claim 1, wherein when said front cap is removed from said front end of said casing and said rear cap is removed from said rear end of said casing, said rear cap fits inside said front end of said casing to engage with said downstream surface of said retainer.

6. The suppressor as in claim 1, wherein said downstream rear cap surface feature comprises a plurality of projections that extend axially downstream from said downstream surface of said rear cap.

7. The suppressor as in claim 1, wherein one of said upstream rear cap surface feature or said upstream front cap surface feature comprises a male fitting and the other of said upstream rear cap surface feature or said upstream front cap surface feature comprises a female fitting.

8. A suppressor for a firearm, comprising:

a casing that defines a rear end opposed to a front end;

a plurality of baffles inside said casing;

a front cap releasably coupled to said front end of said casing downstream from said plurality of baffles, wherein said front cap has an upstream surface;

a retainer releasably coupled to said casing between said plurality of baffles and said front cap, wherein said retainer has a downstream surface;

a rear cap releasably coupled to said rear end of said casing upstream from said plurality of baffles, wherein said rear cap has an upstream surface and a downstream surface;

a downstream rear cap surface feature defined by said downstream surface of said rear cap that has a complementary shape to said downstream surface of said retainer;

wherein when said front cap is removed from said front end of said casing and said rear cap is removed from said rear end of said casing, said downstream rear cap surface feature can engage with said downstream surface of said retainer to remove said retainer from said casing.

9. The suppressor as in claim 8, wherein said retainer is in threaded engagement with said casing.

10. The suppressor as in claim 8, wherein said downstream surface of said retainer comprises a plurality of walls that extend axially downstream from said downstream surface of said retainer.

11. The suppressor as in claim 8, wherein when said front cap is removed from said front end of said casing and said rear cap is removed from said rear end of said casing, said rear cap fits inside said front end of said casing to engage with said downstream surface of said retainer.

12. The suppressor as in claim 8, wherein said downstream rear cap surface feature comprises a plurality of projections that extend axially downstream from said downstream surface of said rear cap.

13. A suppressor for a firearm, comprising:

a casing;

a front cap;

a plurality of baffles inside said casing;

a retainer releasably coupled to said casing downstream from said plurality of baffles, wherein said retainer has a downstream surface;

a rear cap releasably coupled to said casing upstream from said plurality of baffles, wherein said rear cap has an upstream surface and a downstream surface;

a downstream rear cap surface feature defined by said downstream surface of said rear cap that has a complementary shape to said downstream surface of said retainer;

wherein when said rear cap is removed from said casing, said downstream rear cap surface feature can engage with said downstream surface of said retainer to remove said retainer from said casing.

14. The suppressor as in claim 13, wherein said retainer is in threaded engagement with said casing.

15. The suppressor as in claim 13, wherein said downstream surface of said retainer comprises a plurality of walls that extend axially downstream from said downstream surface of said retainer.

16. The suppressor as in claim 13, wherein when said rear cap is removed from said casing, said rear cap fits inside said casing to engage with said downstream surface of said retainer.

17. The suppressor as in claim 13, wherein said downstream rear cap surface feature comprises a plurality of projections that extend axially downstream from said downstream surface of said rear cap.

18. The suppressor as in claim 13, further comprising:

wherein said front cap is releasably coupled to said casing downstream from said plurality of baffles, wherein said front cap has an upstream surface;

an upstream front cap surface feature defined by said upstream surface of said front cap;

an upstream rear cap surface feature defined by said upstream surface of said rear cap that has a complementary shape to said upstream front cap surface feature; and wherein when said front cap is removed from said casing, said upstream front cap surface feature can engage with said upstream rear cap surface feature to remove said rear cap from said casing.

19. The suppressor as in claim 18, wherein said upstream front cap surface feature extends radially inward from said upstream surface of said front cap and comprises a plurality of vertices separated by a plurality of sides.

20. The suppressor as in claim 18, wherein one of said upstream rear cap surface feature or said upstream front cap surface feature comprises a male fitting and the other of said upstream rear cap surface feature or said upstream front cap surface feature comprises a female fitting.

* * * * *